US008626029B2

(12) United States Patent
Fujiwara et al.

(10) Patent No.: US 8,626,029 B2
(45) Date of Patent: Jan. 7, 2014

(54) IMAGE FORMING APPARATUS WITH POWER TRANSMISSION SYSTEM CONFIGURED TO ATTENUATE OSCILLATION

(75) Inventors: Takashi Fujiwara, Toyohashi (JP); Shoichi Yoshikawa, Okazaki (JP); Tadayasu Sekioka, Toyohashi (JP); Noboru Oomoto, Toyokawa (JP); Yoshiyuki Toso, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 34 days.

(21) Appl. No.: 13/323,897

(22) Filed: Dec. 13, 2011

(65) Prior Publication Data

US 2012/0148305 A1 Jun. 14, 2012

(30) Foreign Application Priority Data

Dec. 14, 2010 (JP) ..... 2010-278415

(51) Int. Cl.
*G03G 15/00* (2006.01)

(52) U.S. Cl.
USPC ..... 399/167

(58) Field of Classification Search
USPC ..... 399/167, 117, 116; 192/3.21
See application file for complete search history.

(56) References Cited

U.S. PATENT DOCUMENTS

| | | | |
|---|---|---|---|
| 7,596,342 | B2 | 9/2009 | Yasumoto |
| 2005/0025523 | A1* | 2/2005 | Iwasaki et al. ..... 399/167 |

FOREIGN PATENT DOCUMENTS

| | | | |
|---|---|---|---|
| JP | 04027961 | A | 1/1992 |
| JP | 08054047 | A | 2/1996 |
| JP | 11-101308 | A | 4/1999 |
| JP | 2002-174932 | A | 6/2002 |
| JP | 2003036007 | A | 2/2003 |
| JP | 2003145903 | A | 5/2003 |
| JP | 2005-240938 | A | 9/2005 |
| JP | 2007-333058 | A | 12/2007 |
| JP | 2010-102247 | A | 5/2010 |

OTHER PUBLICATIONS

Office Action from Japanese Patent Office dated Nov. 21, 2012, issued in corresponding Japanese Appln. No. 2010-278415, with English-language translation.

Office Action from Japanese Office Action dated Nov. 21, 2012, issued in corresponding Japanese Appln. No. 2010-281646, with English-language translation.

* cited by examiner

*Primary Examiner* — Billy J Lactaoen
(74) *Attorney, Agent, or Firm* — Buchanan Ingersoll & Rooney PC

(57) ABSTRACT

An image forming apparatus includes an image carrier that rotates by power generated by a driving source. A power transmission system transmits the power from the driving source to the image carrier. The power transmission system includes a coupling member to attenuate oscillation. The coupling member includes a viscous fluid, male and female fittings, and a rotating resistor. The viscous fluid provides a resistance against rotation of the image carrier. The male and female fittings are mutually fitted and rotatably supported on a rotary shaft of the image carrier penetrating through the male and female fittings in a direction in which they are mutually fitted. The rotating resistor is accommodated together with the viscous fluid in an accommodation space defined by a recess of the male fitting and a bottom inner surface of the female fitting. The rotating resistor integrally rotates with the rotary shaft.

9 Claims, 8 Drawing Sheets

IMAGE FORMING APPARATUS WITH POWER TRANSMISSION SYSTEM CONFIGURED TO ATTENUATE OSCILLATION

CROSS-REFERENCE TO RELATED APPLICATIONS

The present application claims priority under 35 U.S.C. §119 to Japanese Patent Application No. 2010-278415, filed Dec. 14, 2010. The contents of this application are incorporated herein by reference in their entirety.

BACKGROUND OF THE INVENTION

1. Field of the Invention

The present invention relates to an image forming apparatus.

2. Discussion of the Background

Electrographic image forming apparatuses obtain images by forming an electrostatic latent image on the surface of a rotating photoreceptor, visualizing the electrostatic latent image into a toner image on a developer, and electrostatically transferring the toner image onto a recording medium.

Japanese Unexamined Patent Application Publication No. 2002-174932 discloses an image forming apparatus including a photoreceptor drivingly rotated by power generated by a driving motor, and a gear train to transmit the power from the driving motor to the photoreceptor. Between the gears of the gear train, an anti-oscillation rubber material is disposed to serve as a damper to attenuate oscillations transmittable to the photoreceptor.

SUMMARY OF THE INVENTION

According to one aspect of the present invention, an image forming apparatus includes an image carrier and a power transmission system. The image carrier is configured to drivingly rotate by power generated by a driving source. The power transmission system is configured to transmit the power from the driving source to the image carrier. The power transmission system includes a coupling member serving as a damper configured to attenuate oscillation. The coupling member includes a viscous fluid, a male fitting and a female fitting, and a rotating resistor. The viscous fluid is configured to provide a resistance against rotation of the image carrier. The male fitting has a recess. The female fitting has a bottom inner surface. The male fitting and the female fitting are fitted with one another. The male fitting and the female fitting are rotatably supported on a rotary shaft of the image carrier. The rotary shaft penetrates through the male fitting and the female fitting in a direction in which the male fitting and the female fitting are fitted with one another. The rotating resistor is accommodated together with the viscous fluid in an accommodation space defined by the recess of the male fitting and the bottom inner surface of the female fitting. The rotating resistor is configured to integrally rotate with the rotary shaft.

According to another aspect of the present invention, an image forming apparatus includes an image forming unit, a transfer unit, a driving source, and a power transmission system. The image forming unit is configured to form a toner image on an image carrier. The transfer unit is configured to transfer the toner image formed on the image carrier to a recording medium. The driving source is configured to drivingly rotate the image carrier. The power transmission system is configured to transmit power from the driving source to the image carrier. The power transmission system includes a first member, a second member, a spring, and at least one rotating resistor. The first member is rotatably coupled to the driving source and has an accommodation space. The second member shares a common shaft with the first member and is rotatably coupled to the image carrier. The spring has one end coupled to the first member and another end coupled to the second member so as to transmit rotation of the first member to the second member. The at least one rotating resistor is accommodated together with a viscous fluid in the accommodation space of the first member and is configured to rotate in the accommodation space by a driving force generated by the driving source.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
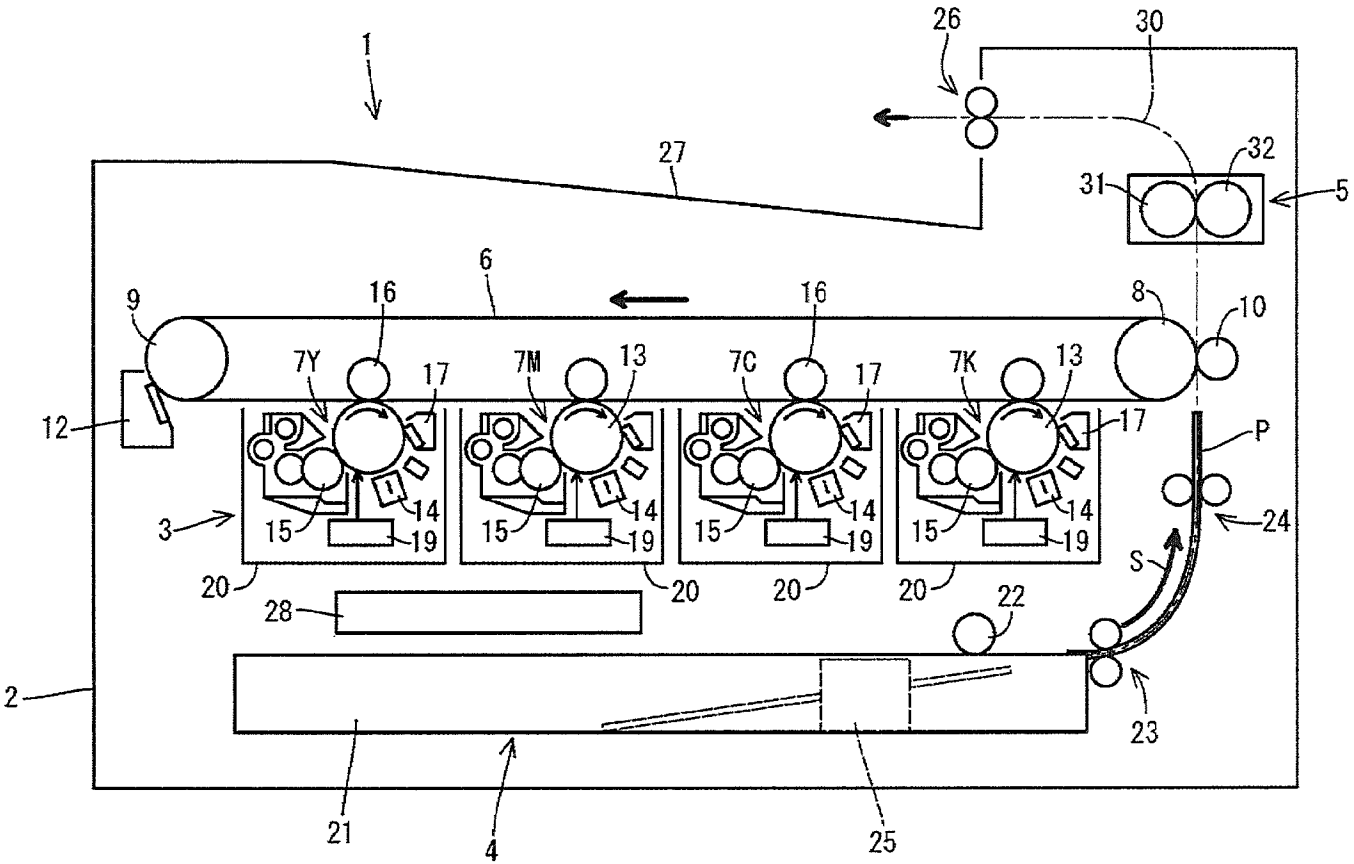
FIG. 1 is a schematic explanatory view of a printer.
Figure 2:
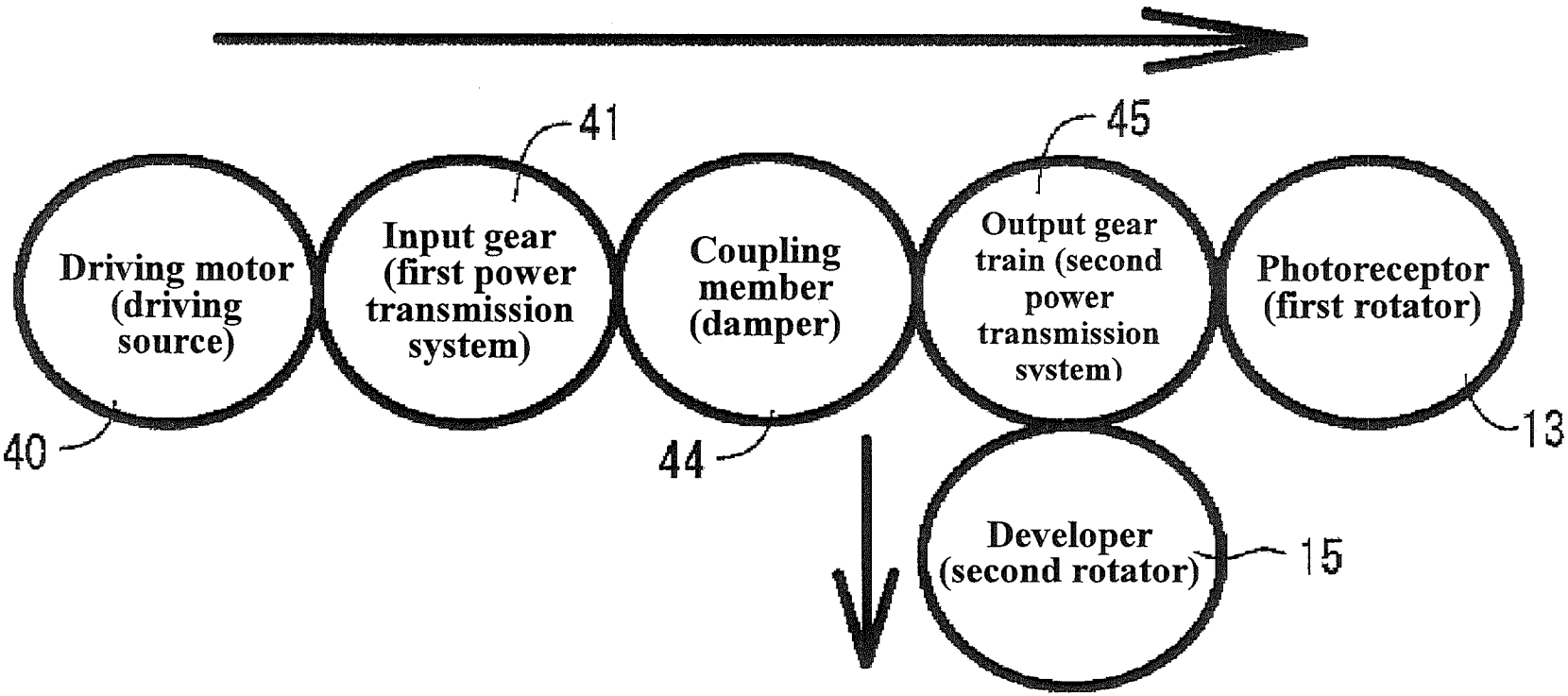
FIG. 2 is a diagram schematically illustrating a power transmission system of an image forming unit.

The embodiments will now be described with reference to the accompanying drawings, wherein like reference numerals designate corresponding or identical elements throughout the various drawings.

In the following embodiments, a tandem color digital printer (hereinafter referred to as a printer) will be described for exemplary purposes. In the following description, terms indicating specific directions and positions (for example, "left and right" and "upper and lower") are used where necessary. In this respect, the direction perpendicular to the paper plane of FIG. 1 is defined as front view. The terms are used for the sake of description and will not limit the technical scope of the present invention.

First Embodiment 1.1 Overview of Printer

An overview of a printer 1 is first described by referring to FIG. 1. As shown in FIG. 1, the printer 1 includes, in a casing 2, an image processor 3, a sheet feeder 4, and a fixing device 5. The printer 1 is coupled to a network such as a LAN so that upon receipt of a print command from an external terminal (not shown), the printer 1 executes printing based on the command, which is not elaborated in the drawings.

The sheet feeder 4 is positioned at a lower portion of the casing 2 and includes a sheet feed cassette 21, a pickup roller 22, a pair of separation rollers 23, and a pair of timing rollers 24. The sheet feed cassette 21 accommodates recording media P. The pickup roller 22 picks up an uppermost part of the recording media P in the sheet feed cassette 21. The pair of separation rollers 23 separate the picked part of recording media P into individual sheets. The pair of timing rollers 24 transfer the individual sheets of recording medium P, one by one, to the image processor 3 at a predetermined timing. The recording media P in the sheet feed cassette 21 are sent to a conveyance path 30 one at a time from the top by the rotation of the pickup roller 22 and the separation rollers 23. The conveyance path 30 extends from the sheet feed cassette 21 of the sheet feeder 4 though a nip portion between the pair of timing rollers 24, a secondary transfer nip portion 11 of the image processor 3, and a fixing nip portion of the fixing device 5, to reach discharging rollers 26 at an upper portion of the casing 2.

In the sheet feed cassette 21, the recording media P are at a center reference on the sheet feed cassette 21 for conveyance toward the conveyance path 30 in the direction of arrow S. In this respect, the center of each recording medium P in its width direction (which is orthogonal to the transfer direction S) is used as a reference relative to the center reference. In this embodiment, the sheet feed cassette 21 includes a pair of side regulation plates 25 to hold unpicked recording media P across the width thereof so as to align the recording media P with the center reference. The pair of side regulation plates 25 simultaneously move close to or away from one another in the sheet width direction (which is orthogonal to the transfer direction S). In the sheet feed cassette 21, the pair of side regulation plates 25 hold both sides of the recording medium P in the sheet width direction. This ensures that recording media P of any standard are set at the center reference in the sheet feed cassette 21. Accordingly, the transfer process at the image processor 3 and the fixing process at the fixing device 5 are executed based on the center reference.

The image processor 3 is above the sheet feeder 4 and transfers toner images on photoreceptors 13, which are exemplary image carriers, to a recording medium P. The image processor 3 includes an intermediate transfer belt 6 and a total of four image forming units 7 respectively corresponding to colors of yellow (Y), magenta (M), cyan (C), and black (K). The intermediate transfer belt 6, which is another exemplary image carrier, is wound across a driving roller 8 and a driven roller 9 respectively disposed on right and left sides at a vertically central position of the casing 2. A secondary transfer roller 10 is disposed on the outer peripheral side of a portion of the intermediate transfer belt 6 wound around the driving roller 8. The intermediate transfer belt 6 and the secondary transfer roller 10 define, at the portion of their contact, a secondary transfer nip portion 11 as a secondary transfer region. A transfer belt cleaner 12 is disposed on the outer peripheral side of a portion of the intermediate transfer belt 6 wound around the driven roller 9. The transfer belt cleaner 12 removes un-transferred toner remaining on the intermediate transfer belt 6. The casing 2 includes a controller 28 in charge of overall control of the printer 1 between the image processor 3 and the sheet feed device 4. The controller 28 incorporates another controller (not shown) in charge of various arithmetic operations, storing, and control.

Below and along the intermediate transfer belt 6, the four image forming units 7 of yellow (Y), magenta (M), cyan (C), and black (K) are arranged in this order starting on the left side of FIG. 1. For the sake of description, in FIG. 1, the image forming units 7 are respectively labeled with symbols Y, M, C, and K in accordance with reproduced colors. Each image forming unit 7 includes a photoreceptor 13. Around the photoreceptor 13, a charger 14, an exposing unit 19, a developer 15, a primary transfer roller 16, and a photoreceptor cleaner 17 are arranged in this order in the clockwise rotational direction of FIG. 1.

In each of the image forming units 7, the exposing unit 19 radiates a laser beam to the photoreceptor 13 charged by the charger 14, thus forming an electrostatic latent image. The electrostatic latent image is reverse developed using toner supplied from the developer 15 into a toner image of a corresponding color. At primary transfer nip portions, the toner images of yellow, magenta, cyan, and black are primary transferred in this order on the outer circumferential surface of the intermediate transfer belt 6 from the photoreceptors 13, and superimposed one on top of each other. Un-transferred toner remaining on the photoreceptors 13 is scraped off the photoreceptors 13 by the respective photoreceptor cleaners 17. The superimposed toner images of the four colors are collectively secondary transferred on the recording medium P through the secondary transfer nip portion 11. Un-transferred toner remaining on the intermediate transfer belt 6 is scrapped off the intermediate transfer belt 6 by the transfer belt cleaner 12.

The fixing device 5 is positioned above the secondary transfer roller 10 of the image processor 3, and includes a fixing roller 31 and a pressure roller 32. The fixing roller 31 incorporates a heat source such as a halogen heater. The pressure roller 32 is opposite the fixing roller 31. The fixing roller 31 and the pressure roller 32 define, at the portion of their contact, a fixing nip portion as a fixing region. The recording medium P past the secondary transfer nip portion 11 and loaded with an unfixed toner image is heated and pressed through the fixing nip portion between the fixing roller 31 and the pressure roller 32. Thus, the unfixed toner image is fixed on the recording medium P. Then, the recording medium P is discharged on a collection tray 27 by the rotation of the pair of discharging rollers 26.

For example, the developer 15 of each image forming unit 7, the intermediate transfer belt 6, and the transfer belt cleaner 12 are consumables subject to wear through repeated image forming operations. The consumables are exchangeably (removably) disposed in the casing 2. For example, each image forming unit 7 (the photoreceptor 13, the charger 14, the exposing unit 19, the developer 15, and the photoreceptor cleaner 17) is incorporated in a housing 20 in the form of a cartridge (integrated structure) and is exchangeably disposed in the casing 2 as what is called a process cartridge.

1.2. Power Transmission Structure of Image Forming Unit

Referring to FIGS. 2 to 5, a power transmission structure of the image forming unit 7 will be described below. The printer 1 includes, on a side of the casing 2, a driving motor 40 serving as a driving source to generate power. The power generated by the driving motor 40 is first transmitted to an input gear 41, which is a component of a first power transmission system. A coupling member 44 serving as a damper to attenuate oscillation is power transmittably coupled to a distal end of a rotary shaft 13*a* outwardly protruding from the photoreceptor 13. The coupling member 44 (specifically, to a male fitting 47, described later) has outer teeth on the outer circumference, and an input gear 41 meshes with the teeth. An output gear 42 is disposed at a portion of the rotary shaft 13*a* between the coupling member 44 and the photoreceptor 13 to integrally rotate with the photoreceptor 13 and branch the power from the driving motor 40. The output gear 42 meshes with an output relay gear 43. Part of the power branched through the output gear 42 and the output relay gear 43 is transmitted to the developer 15, for example.

That is, part of the power generated by the driving motor 40 is transmitted to the photoreceptor 13 through the input gear 41, the coupling member 44, and the output gear 42. The rest of the power is transmitted to the developer 15 through the output gear 42 and the output relay gear 43. The output gear 42 and the output relay gear 43 constitute an output gear train 45.

Figure 3:
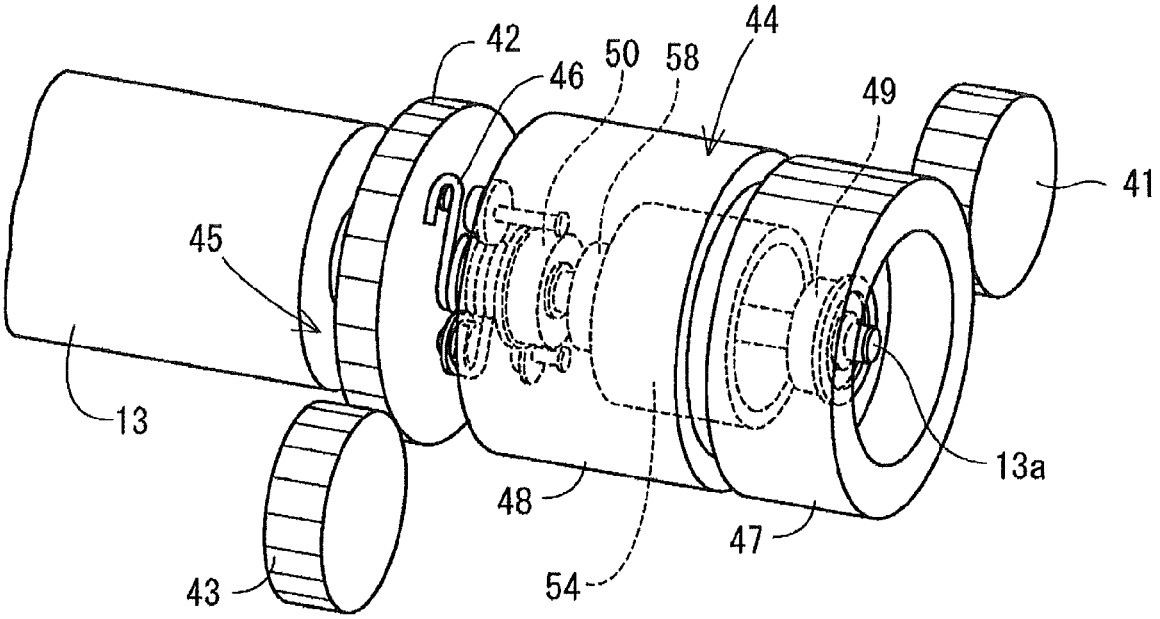
FIG. 3 is a perspective view of the power transmission system of the image forming unit according to a first embodiment.
Figure 4:
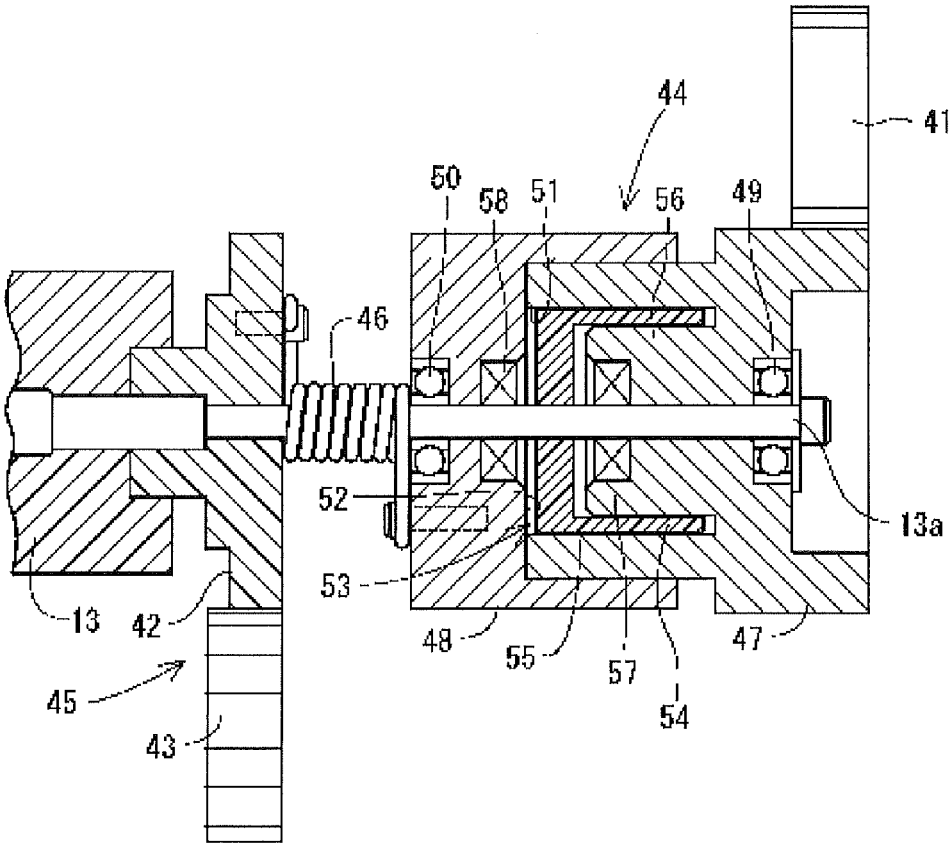
FIG. 4 is a longitudinal sectional view of the power transmission system shown in FIG. 3.

As shown in FIG. 3 and FIG. 4, a linkage spring 46 serving as an elastic body is fitted on a portion of the rotary shaft 13 a of the photoreceptor 13 between the output gear 42 and the coupling member 44. The linkage spring 46 has one end engaged with the output gear 42 and another end engaged with the coupling member 44 (specifically, to a female fitting 48, described later). Thus, the coupling member 44 transmits rotary power to the output gear 43 utilizing the elastic restoring force of the linkage spring 46. Examples of the linkage spring 46 include, but not limited to, a coil spring wound coaxially with the rotary shaft 13*a*.

FIGS. 3 and 4 show the coupling member 44 according to the first embodiment. The coupling member 44 according to the first embodiment includes the male fitting 47 and the female fitting 48 fitted with one another. The rotary shaft 13*a* penetrates through the male and female fittings 47 and 48 in the direction in which the male and female fittings 47 and 48 are fitted with one another, so as to rotatably support the male and female fittings 47 and 48 respectively via shaft bearings 49 and 50. The male fitting 47 has a recess 51 on the side fitted with the female fitting 48. The male and female fittings 47 and 48 are fitted with one another by press fitting or other means that makes them difficult to fall apart. With the male and female fittings 47 and 48 fitted with one another, the recess 51 of the male fitting 47 and a bottom inner surface 52 of the female fitting 48 define a hollow accommodation space 53 in the coupling member 44. The accommodation space 53 in the coupling member 44 accommodates, together with a viscous fluid 55, a rotating resistor 54 to rotate integrally with the rotary shaft 13*a* of the photoreceptor 13.

The viscous fluid 55 provides a viscous resistance (rotation resistance) to the rotating resistor 54 when the rotating resistor 54 integrally rotates with the rotary shaft 13*a* of the photoreceptor 13. This effects a relative rotation between the rotating resistor 54 and the coupling member 44 (that is, a rotation delay of the rotating resistor 54 results). The viscous resistance is obtained in association with shear resistance and agitation resistance of the viscous fluid 55. The viscous fluid 55 is not limited to a particular type. Examples include, but not limited to, grease and a highly viscous fluid such as silicone oil.

In the coupling member 44 according to the first embodiment, the rotating resistor 54 has a cylindrical shape with one end open. In the recess 51, the male fitting 47 has a cylindrical protrusion 56 fitted with the opening on the one end of the rotating resistor 54. The rotating resistor 54 covers the cylindrical protrusion 56 in the recess 51 of the male fitting 47. A slight gap exists between the outer circumferential surface of the cylindrical protrusion 56 and the inner circumferential surface of the rotation resistance 54. Similarly, a slight gap exists between the outer circumferential surface of the rotation resistance 54 and the inner circumferential surface of the recess 51 of the male fitting 47. The viscous fluid 55 fills the gaps. An oil seal 57 to prevent leakage of the inner viscous fluid 55 is disposed at a portion of the cylindrical protrusion 56 of the male fitting 47 where the rotary shat 13*a* penetrates. Similarly, an oil seal 58 to prevent leakage of the inner viscous fluid 55 is disposed at a portion of the bottom inner surface 52 of the female fitting 48 where the rotary shat 13*a* penetrates.

With the above-described configuration, the power through the driving motor 40 and the input gear 41 is first transmitted to the coupling member 44 (specifically, to the male fitting 47). The rotating resistor 54 in the coupling member 44 attempts to integrally rotate with the rotary shaft 13*a* while receiving a viscous resistance of the viscous fluid 55. This effects a relative rotation between the rotating resistor 54 and the coupling member 44 (that is, a rotation delay of the rotating resistor 54 results). If, for example, an oscillation results from varying rotation rates of the driving motor 40, the oscillation is attenuated by the viscous fluid 55. With the oscillation attenuated, the power is transmitted to the photoreceptor 13 through the rotary shaft 13*a*, which integrally rotates with the rotating resistor 54, so as to drivingly rotate the photoreceptor 13. This, as a result, significantly reduces varying rotation rates of the photoreceptor 13 and minimizes image blurring (banding), thereby improving image quality. It is particularly noted that the image forming unit 7 is exchangeably disposed in the casing 2 in the form of what is called a process cartridge, which additionally advantageously simplifies the power transmission system and reduces size and weight of the power transmission system.

Figure 5:
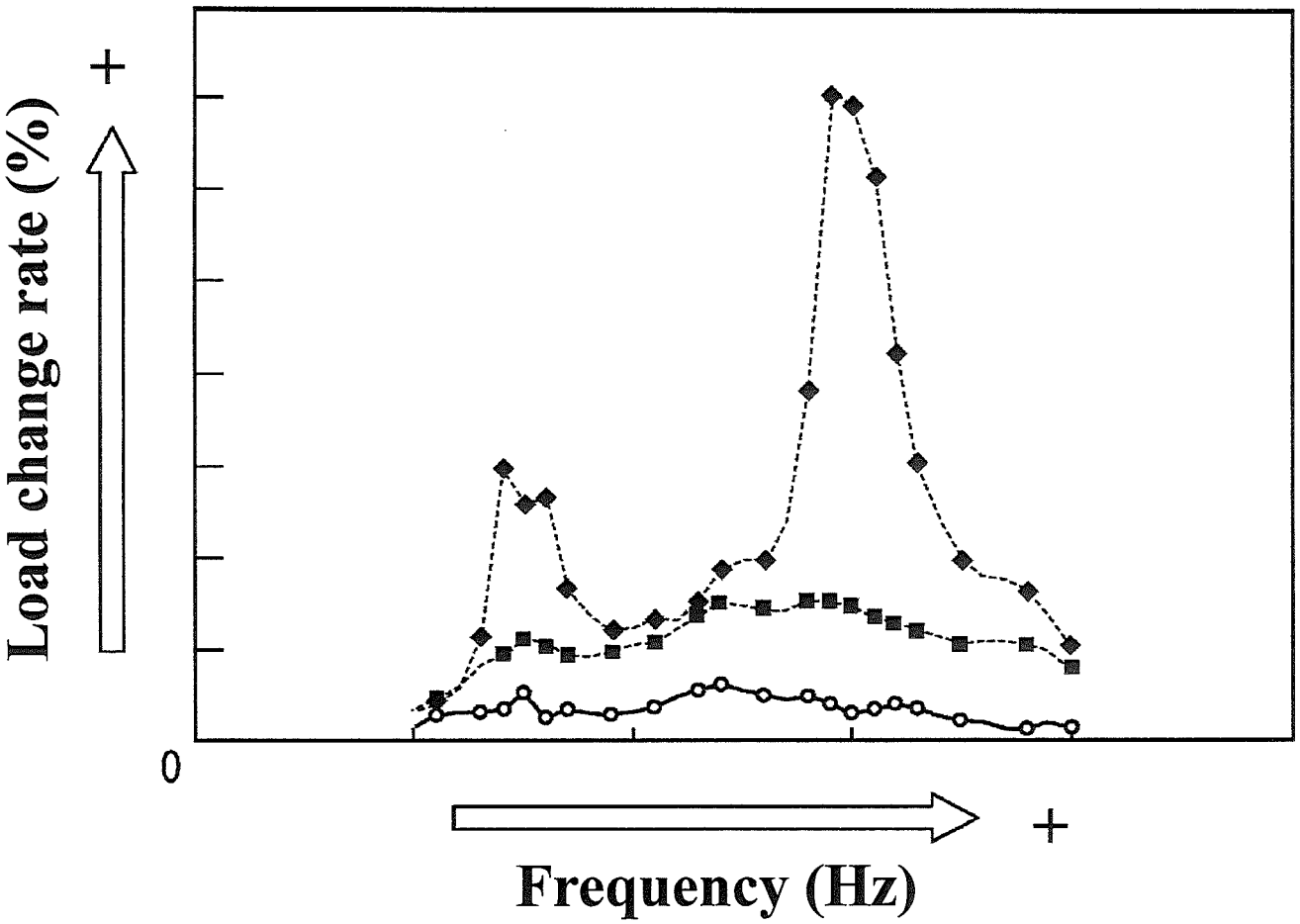
FIG. 5 is a graph showing how differences between coupling members influence the load change rate of a photoreceptor.

FIG. 5 shows results of an experiment on how differences between dampers influence the load change rate (variations in the rotation rate) of the photoreceptor 13. The graph of FIG. 5 shows frequencies on the horizontal axis and load change rates on the vertical axis. In FIG. 5, the symbol "◆" represents a resin material as the damper, "■" represents an anti-oscillation rubber material as the damper, and "○" represents the coupling member 44 as the damper. As shown in FIG. 5, the case where the coupling member 44 is used as the damper (the case of "○") significantly reduces the varying rotation rate over a wide range of frequencies compared with the other examples. These prove that the existence of the coupling member 44 reduces the influence that varying rotation rates of the photoreceptor 13 have on the image forming operation, thereby ensuring high image quality.

Second Embodiment

Figure 6:
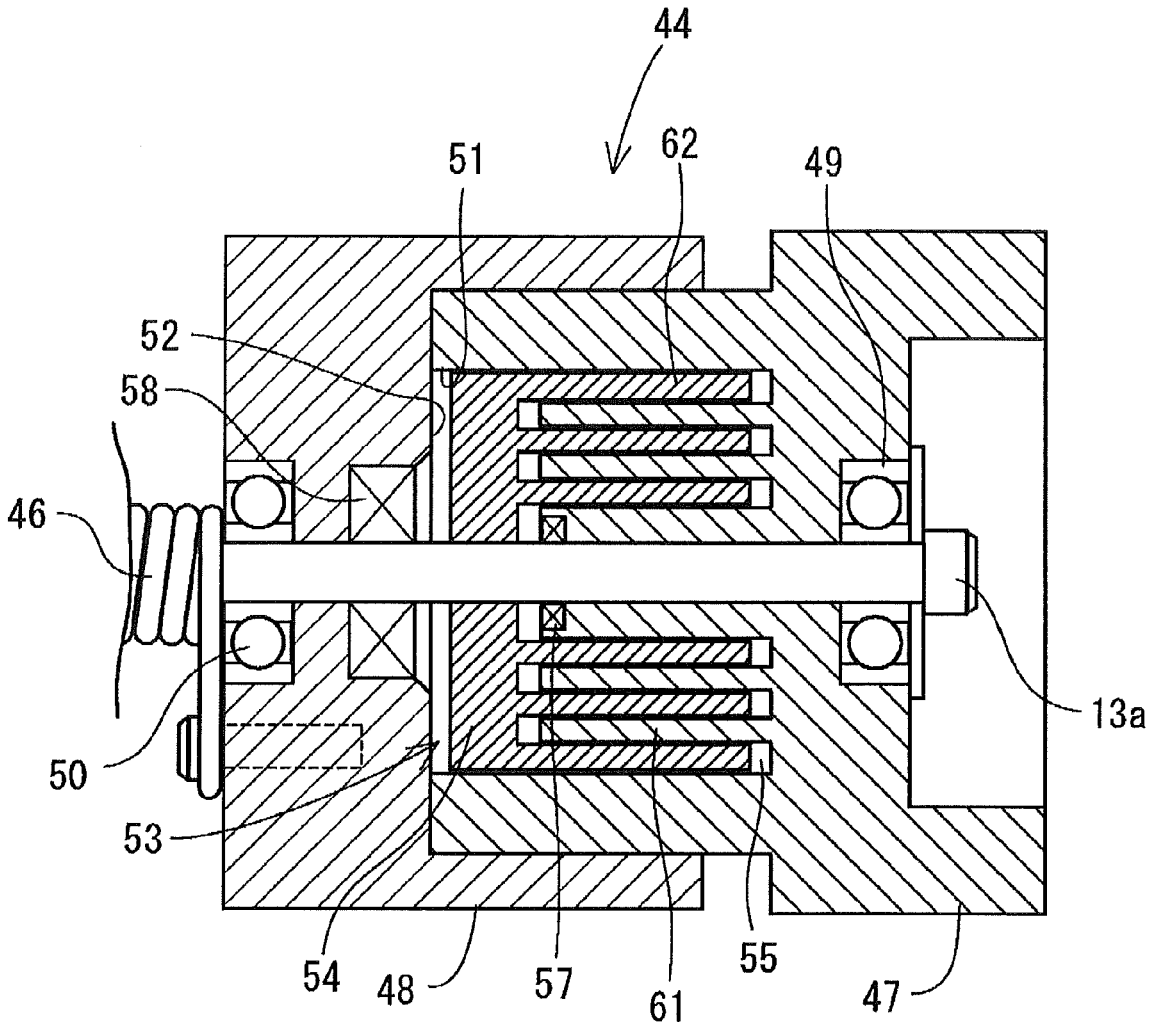
FIG. 6 is a longitudinal sectional view of a coupling member according to a second embodiment.

A second embodiment of the coupling member will be described by referring to FIG. 6. In the second embodiment described below, those elements common in configuration and operation to the first embodiment are identified using the same reference numerals, and therefore will not be further elaborated here. The coupling member 44 according to the second embodiment includes a plurality of annular protrusions 62 (which may also be regarded as recesses and protrusions) disposed on the rotating resistor 54. The annular protrusions 62 are disposed coaxially and radially around the rotary shaft 13*a*. The recess 51 of the male fitting 47 includes a plurality of annular protrusions 61 in mesh with the annular protrusions 62 of the rotating resistor 54 along the rotary shaft 13*a*. In other words, the inner peripheral portion (that is, the recess 51) of the coupling member 44 has a sectional profile in the form of a comb, and the rotating resistor 54 has a sectional profile in the form of a comb in mesh with the comb of the sectional profile of the inner peripheral portion of the coupling member 44. The annular protrusions 61 of the male fitting 47 and the annular protrusions 62 of the rotating resistor 54 mesh with each other with slight gaps disposed between the annular protrusions 61 and the annular protrusions 62 (that is, the annular protrusions 61 and 62 loosely mesh with each other). The viscous fluid 55 is disposed in the gaps.

This configuration ensures a large area of contact between the viscous fluid 55 and the inner peripheral portion (that is, the recess 51) of the coupling member 44 as well as the rotating resistor 54. This improves the function of the viscous fluid 55 providing viscous resistance to the rotation of the photoreceptor 13, and further reduces varying rotation rates of the photoreceptor 13. This, as a result, minimizes image blurring (banding), thereby further improving image quality.

Third Embodiment

Figure 7:
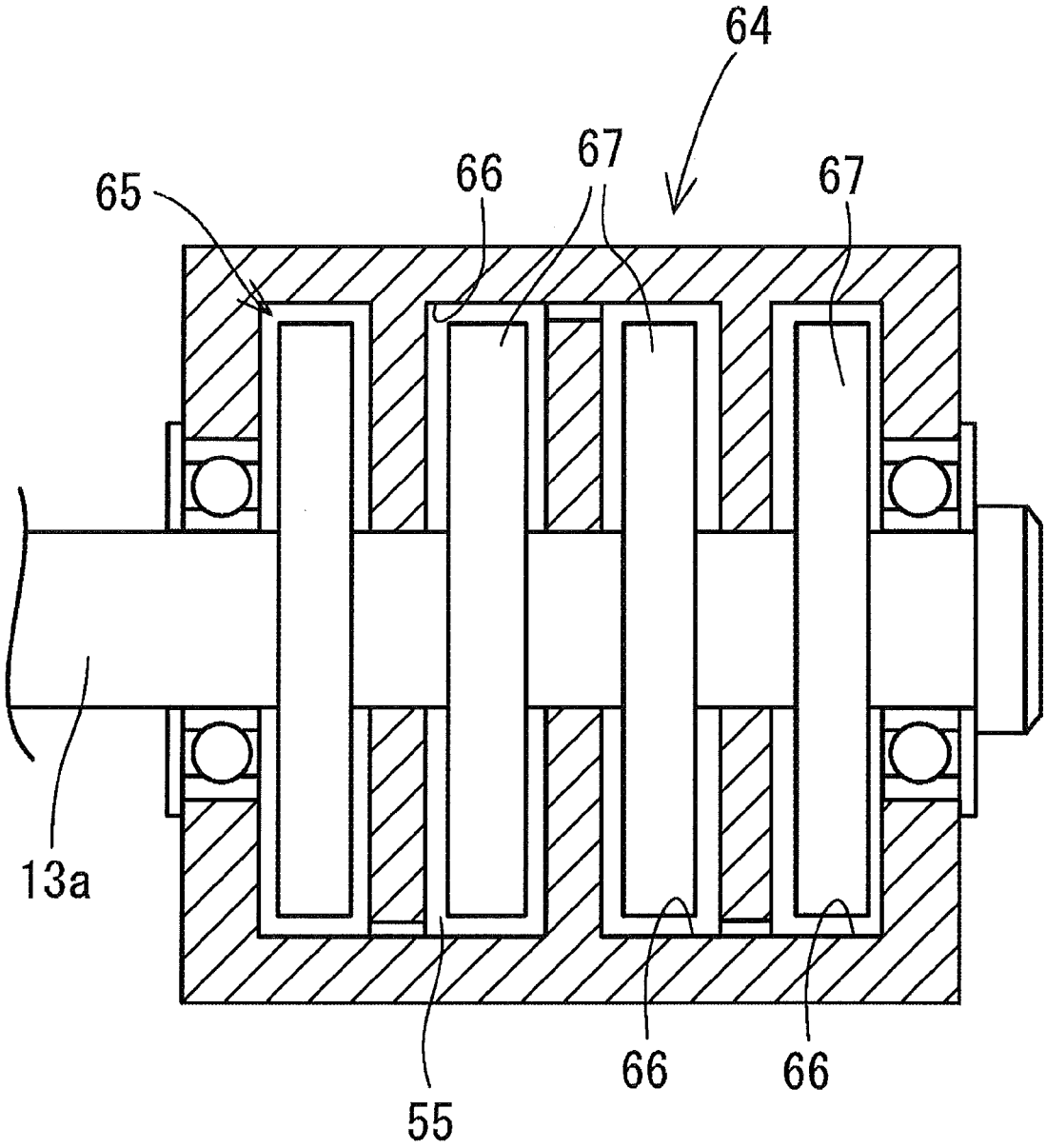
FIG. 7 is a longitudinal sectional view of a coupling member according to a third embodiment.

A third embodiment of the coupling member will be described by referring to FIG. 7. In the third embodiment, a coupling member 64 includes an accommodation space 65 having a plurality of compartments 66 aligned along the rotary shaft 13*a* of the photoreceptor 13. The coupling member 64 is rotatably supported on the rotary shaft 13*a*. At the portions of the rotary axis 13*a* corresponding to the compartments 66, disk-shaped rotating resistors 67 are disposed to integrally rotate with the rotary shaft 13*a*. The viscous fluid 55 is disposed in the compartments 66 to move between adjacent compartments 66. The coupling member 64 is dividable at the rotary shaft 13*a* serving as the center of division. It is matter of course that the coupling member 64 has outer teeth on the outer circumference in mesh with the input gear 41.

Similarly to the second embodiment, the third embodiment is another example where the inner peripheral portion (that is, the compartments 66) of the coupling member 64 has a sectional profile in the form of a comb, and the rotating resistors 67 have a sectional profile in the form of a comb in mesh with the comb of the sectional profile of the inner peripheral portion of the coupling member 64. This ensures a large area of contact between the viscous fluid 55 and the inner peripheral portion of the coupling member 64 as well as the rotating resistors 67. This, as a result, improves the function of the viscous fluid 55 providing viscous resistance to the rotation of the photoreceptor 13.

Fourth Embodiment

Figure 8:
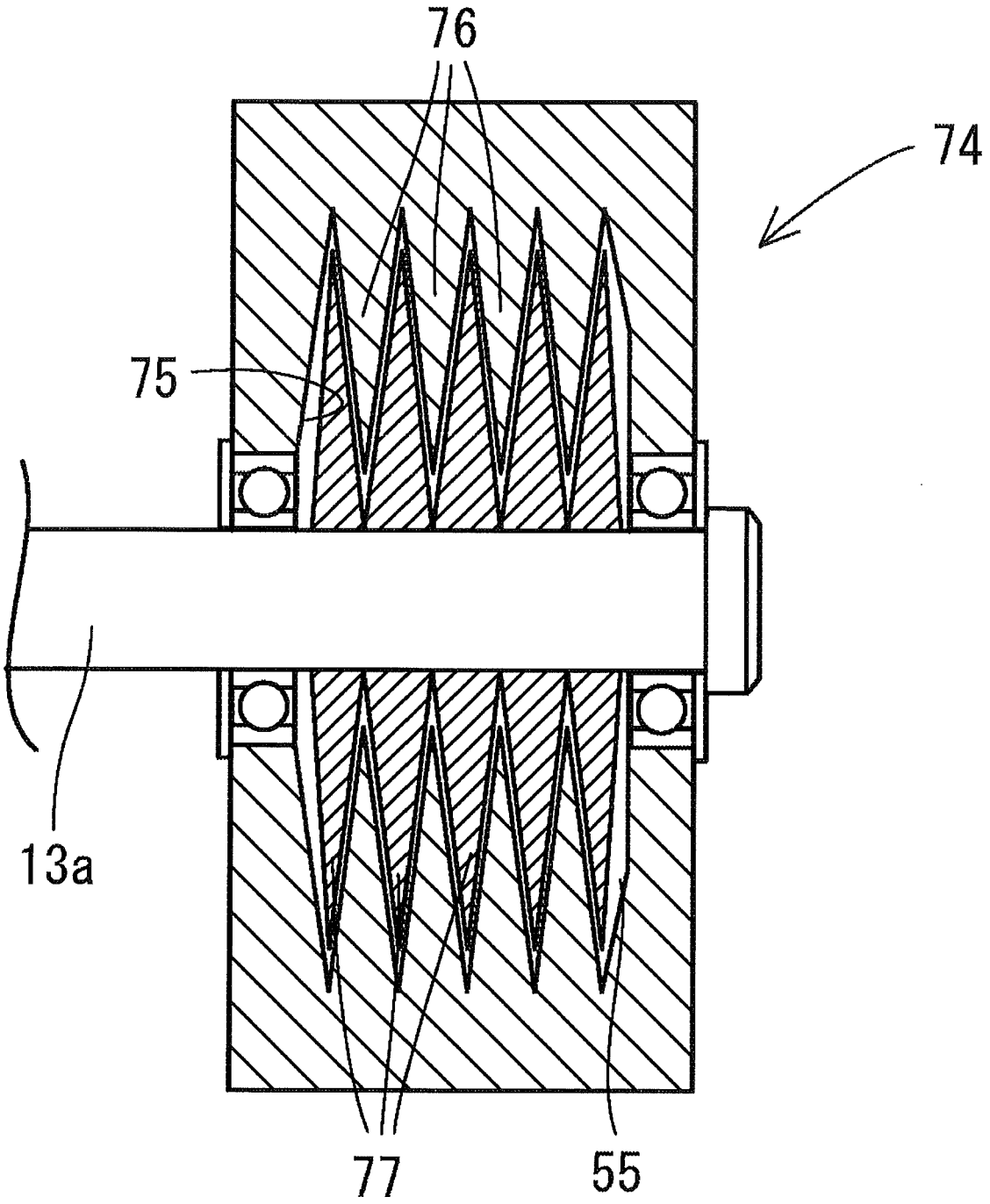
FIG. 8 is a longitudinal sectional view of a coupling member according to a fourth embodiment.

A fourth embodiment of the coupling member will be described by referring to FIG. 8. In the fourth embodiment, a coupling member 74 includes an accommodation space 75 having a plurality of fixed ring plates 76 aligned along the rotary shaft 13*a* of the photoreceptor 13. The coupling member 74 is rotatably supported on the rotary shaft 13*a*. On the rotary shaft 13*a*, disk-shaped rotating resistors 77 are disposed at appropriate intervals to integrally rotate with the rotary shaft 13*a*. The fixed ring plates 76 and the rotating resistors 77 are alternately disposed. The viscous fluid 55 is disposed in the void in the accommodation space 75. The coupling member 74 is dividable at the rotary shaft 13*a* serving as the center of division. It is matter of course that the coupling member 74 has outer teeth on the outer circumference in mesh with the input gear 41.

Similarly to the second and third embodiments, the fourth embodiment is another example where the inner peripheral portion (that is, the fixed ring plates 76) of the coupling member 74 has a sectional profile in the form of a comb, and the rotating resistors 77 have a sectional profile in the form of a comb in mesh with the comb of the sectional profile of the inner peripheral portion of the coupling member 74. This ensures a large area of contact between the viscous fluid 55 and the inner peripheral portion of the coupling member 74 as well as the rotating resistors 77. This, as a result, improves the function of the viscous fluid 55 providing viscous resistance to the rotation of the photoreceptor 13.

Other Notes

It will be appreciated that the present invention will not be limited to the embodiments described above and can be embodied in various other forms. For example, while a printer has been described as an exemplary image forming apparatus, this should not be construed in a limiting sense. Other possible examples include copiers, fax machines, and multifunction machines integrally incorporating copy and fax capabilities. Moreover, the location or arrangement of individual elements in the illustrated embodiments should not be construed in a limiting sense. Various modifications can be made without departing from the scope of the present invention.

Thus, in the embodiments, a coupling member containing a viscous fluid 55 serves as a damper to attenuate oscillation in the power transmission system, by which power is transmitted from the driving motor 40 to image carriers (including the image processor 3 and the intermediate transfer belt 6). The viscous fluid 55 provides a resistance against the rotation of the image carriers, and thereby attenuates oscillations resulting from varying rotation rates of the driving motor 40. This ensures that the image carriers are drivingly rotated by the power with the oscillations attenuated. This, as a result, significantly reduces varying rotation rates of the image carriers and minimizes image blurring (banding), thereby improving image quality. The existence of the coupling member 44 reduces, over a wide range of frequencies, the influence that varying rotation rates of the photoreceptor 13 have on the image forming operation, thereby ensuring high image quality.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus comprising:

an image carrier configured to drivingly rotate by power generated by a driving source; and a power transmission system configured to transmit the power from the driving source to the image carrier, the power transmission system comprising a coupling member serving as a damper configured to attenuate oscillation, the coupling member comprising:

a viscous fluid configured to provide a resistance against rotation of the image carrier, a male fitting having a recess formed by an inner circumferential surface of the male fitting and an inner bottom surface of the male fitting, a female fitting having an inner bottom surface, the male fitting and the female fitting being fitted with one another so that the inner bottom surface of the male fitting faces the inner bottom surface of the female fitting, a rotary shaft of the image carrier penetrating through the male fitting and the female fitting in a direction in which the male fitting and the female fitting are fitted with one another, a rotating resistor being configured to integrally rotate with the rotary shaft, the male fitting and the female fitting each being rotatable relative to the rotary shaft, and the rotating resistor being positioned together with the viscous fluid in the recess of the male fitting so that the rotating resistor is surrounded by the inner circumferential surface of the male fitting and so that the rotating resistor is bordered on opposite sides by the inner bottom surface of the male fitting and the inner bottom surface of the female fitting.

2. The image forming apparatus according to claim 1, wherein the coupling member has an inner peripheral portion having a sectional profile in a form of a comb, and the rotating resistor has a sectional profile in a form of a comb in mesh with the comb of the sectional profile of the inner peripheral portion of the coupling member.

3. An image forming apparatus comprising:

an image forming unit configured to form a toner image on an image carrier;

a transfer unit configured to transfer the toner image formed on the image carrier to a recording medium;

a driving source configured to drivingly rotate the image carrier; and a power transmission system configured to transmit power from the driving source to the image carrier, the power transmission system comprising:

a first member rotatably coupled to the driving source and having an interior accommodation space, a second member sharing a common shaft with the first member and rotatably coupled to the image carrier, a spring having one end coupled to the first member and another end coupled to the second member so as to transmit rotation of the first member to the second member, and at least one rotating resistor enclosed together with a viscous fluid in the interior accommodation space of the first member so that the rotating resistor is not exposed to an exterior of the first member, the rotating resistor being configured to rotate in the interior accommodation space of the first member by a driving force generated by the driving source.

4. The image forming apparatus according to claim 3, wherein the interior accommodation space of the first member is coaxial with the shaft, wherein the interior accommodation space of the first member has a cylindrical space, and the at least one rotating resistor comprises a cylindrical structure fitting in the cylindrical space of the accommodation space of the first member with a gap disposed between the cylindrical space and the cylindrical structure, and wherein the viscous fluid is disposed between a wall of the at least one rotating resistor and a wall of the first member.

5. The image forming apparatus according to claim 3, wherein the first member comprises a plurality of cylindrical protrusions coaxial with the shaft and positioned in the interior accommodation space of the first member, wherein the at least one rotating resistor comprises a plurality of cylindrical protrusions coaxial with the shaft to fit in the plurality of cylindrical protrusions positioned in the interior accommodation space of the first member with a gap disposed between the plurality of cylindrical protrusions of the at least one rotating resistor and the plurality of cylindrical protrusions, and wherein the viscous fluid is disposed between a wall of the plurality of cylindrical protrusions of the at least one rotating resistor and a wall of the plurality of cylindrical protrusions.

6. The image forming apparatus according to claim 3, wherein the interior accommodation space of the first member has a plurality of disk-shaped spaces along the shaft, wherein the at least one rotating resistor comprises a plurality of disks fitting in the plurality of respective disk-shaped spaces with a gap disposed between the plurality of disks and the plurality of respective disk-shaped spaces, and wherein the viscous fluid is disposed between a wall of each of the plurality of disks and a wall of each of the plurality of respective disk-shaped spaces.

7. The image forming apparatus according to claim 3, wherein the spring comprises a coil spring wound coaxially with the shaft.

8. The image forming apparatus according to claim 1, wherein the male fitting is rotatably mounted on the rotary shaft by a bearing.

9. The image forming apparatus according to claim 3, wherein the first member is rotatably mounted on the common shaft by a bearing.

* * * * *